United States Patent [19]

Tomisawa

[11] Patent Number: 4,800,857

[45] Date of Patent: Jan. 31, 1989

[54] APPARATUS FOR LEARN-CONTROLLING AIR-FUEL RATIO FOR INTERNAL COMBUSTION ENGINE

[75] Inventor: Naoki Tomisawa, Isesaki, Japan

[73] Assignee: Nippon Denshi Kiki Co., Ltd., Isesaki, Japan

[21] Appl. No.: 146,085

[22] Filed: Jan. 20, 1988

[30] Foreign Application Priority Data

Jan. 21, 1987 [JP] Japan ..... 62-10089

[51] Int. Cl.[4] ..... F02M 51/00

[52] U.S. Cl. ..... 123/489; 123/440; 123/416; 123/417

[58] Field of Search ..... 123/489, 440, 416, 417, 123/478, 480

[56] References Cited

U.S. PATENT DOCUMENTS

| | | | |
|---|---|---|---|
| 4,615,319 | 10/1986 | Tomisawa | 123/440 |
| 4,655,188 | 4/1987 | Tomisawa et al. | 123/489 |
| 4,707,984 | 11/1987 | Katsuro et al. | 123/489 |
| 4,707,985 | 11/1987 | Nagai et al. | 123/489 |
| 4,715,344 | 12/1987 | Tomisawa | 123/489 |
| 4,726,344 | 2/1988 | Ando et al | 123/489 |
| 4,729,359 | 3/1988 | Tomisawa et al. | 123/440 |
| 4,748,956 | 6/1988 | Iwaki | 123/489 |

FOREIGN PATENT DOCUMENTS

| | | | |
|---|---|---|---|
| 58-150057 | 9/1983 | Japan | 123/489 |
| 58-53184 | 11/1983 | Japan | 123/489 |
| 60-90944 | 5/1985 | Japan | 123/489 |
| 61-190142 | 8/1986 | Japan | 123/489 |

*Primary Examiner*—Raymond A. Nelli

*Attorney, Agent, or Firm*—Foley & Lardner, Schwartz, Jeffery, Schwaab, Mack, Blumenthal & Evans

[57] ABSTRACT

An apparatus for learn-controlling the air-fuel ratio for an internal combustion engine is disclosed. Every time area-wise learning correction coefficients for a predetermined number of different engine running condition areas are corrected, it is judged whether or not the deviations of the present area-wise learning correction coefficients for said areas from a reference value have the same direction. If all the deviations have the same direction, a mean value of said deviations or a minimum value among the deviations in terms of the absolute value is calculated. The calculated mean or minimum value is added to a global learning correction coefficient stored in global learning correction coefficient storing means to thereby rewrite the stored data. The mean or minimum value is regarded as a deviation component due to a change in the air density which may uniformly be employed for all the areas and is substituted for the global learning correction coefficient. Thus, it is possible to promptly learn a deviation component due to a change in the air density, and it is therefore possible to effect excellent learning control of the air-fuel ratio even when the vehicle abruptly goes up or down a slope.

10 Claims, 11 Drawing Sheets

APPARATUS FOR LEARN-CONTROLLING AIR-FUEL RATIO FOR INTERNAL COMBUSTION ENGINE

BACKGROUND OF THE INVENTION

1. Field of the Invention

The present invention relates to an apparatus for learn-controlling the air-fuel ratio for an automotive internal combustion engine having an electronically controlled fuel injection device which is provided with an air-fuel ratio feedback control function. More particularly, the present invention pertains to an apparatus for learn-controlling the air-fuel ratio which is capable of effectively coping with changes in the air density caused by the change in altitude or the like.

2. Description of the Related Art

An air-fuel ratio learning control apparatus such as that shown, for example, in Japanese Patent Laid-Open Nos. 60-90944 (90944/1985) and 61-190142 (190142/1986) has heretofore been adopted in internal combustion engines having an electronically-controlled fuel injection device which is provided with an air-fuel ratio feedback control function.

This type of conventional learning control apparatus is basically arranged such that a basic fuel injection quantity is calculated on the basis of parameters (e.g., an engine intake air flow rate and an engine speed), which represent an engine running condition and which are concerned with the quantity of air which is sucked into the engine, and the calculated basic fuel injection quantity is corrected by a feedback correction coefficient which is set by proportional plus integral control based on a signal delivered from an $O_2$ sensor which is provided in the engine exhaust system, thereby calculating a fuel injection quantity, and thus effecting feedback control so that the air-fuel ratio may be coincident with a target air-fuel ratio. In an improved type of the above-described kind of conventional learning control apparatus, a deviation of the feedback correction coefficient from a reference value during the air-fuel ratio feedback control is learned for each of the predetermined engine running condition areas to determine a learning correction coefficient for each area, and when a fuel injection quantity is to be calculated, the basic fuel injection quantity is corrected by the learning correction coefficient for each area so that a base air-fuel ratio which is obtained from a fuel injection quantity calculated without correction by the feedback correction coefficient may be coincident with a target air-fuel ratio. During the air-fuel ratio feedback control, the area-wise learning correction coefficient is further corrected by the feedback correction coefficient to calculate a fuel injection quantity.

According to the above-described arrangement, when the air-fuel ratio feedback control is being effected, it is possible to eliminate the follow-up delay in the feedback control at the time of a transient engine running condition, whereas, when the air-fuel ratio feedback control is suspended, it is possible to accurately obtain a desired air-fuel ratio.

In the case where a flap type (a volume flow rate detecting type) air flowmeter is employed in a system wherein a basic fuel injection quantity Tp is determined from a throttle valve opening $\alpha$ and an engine speed N [e.g., a system wherein an intake air flow rate Q is obtained from $\alpha$ and N with reference to a map and Tp is calculated according to the equation: $Tp=K.Q/N$ (K is a constant)] or a system wherein an intake air flow rate Q is detected by means of an air flowmeter and a basic fuel injection quantity $Tp=K\ Q/N$ from the detected intake air flow rate Q and the engine speed N, a change in the air density is not reflected upon the calculated basic fuel injection quantity. However, it is possible according to the above-described learning control to cope with a change in the air density due to a change in the altitude or in the intake air temperature as long as the learning control progresses effectively.

Considering a case wherein a vehicle which is equipped with the aforementioned learning control apparatus abruptly goes up a hill, however, since a transient engine running pattern is employed while the vehicle is climbing the hill, the system in which learning control is executed for each of the engine running condition areas suffers from the problem that an area for learning cannot readily be determined; even if learning can be executed, the learning areas are undesirably limited, and learning cannot hardly progress in the greater part of the areas. Thus, when the vehicle comes into an ordinary running state, for example, at a flat area near the top of the hill, a delay is caused in the air-fuel ratio feedback control, and when the air-fuel ratio feedback control has been suspended, the base air-fuel ratio is deviated from the target air-fuel ratio by a large margin, resulting in a failure of driveability.

The reason for the above-described disadvantages is as follows. It is necessary to correct a deviation component due to a change in the air density by learning it from the deviation of the feedback correction coefficient from a reference value during the air-fuel ratio feedback control. However, since the learned deviation also includes the deviation of the base air-fuel ratio dependent on the engine running condition which deviation is caused by variations in parts such as a fuel injection valve and a throttle body, it is impossible to separate the deviation component due to a change in the air density from the learned deviation, and it is therefore necessary to learn for each of the engine running condition areas the deviation component due to a change in the air density which must originally be able to be learned globally. Accordingly, in the case where the air density suddenly changes, for example, when the vehicle abruptly goes up a hill, learning cannot be executed for each area, so that substantially no learning control progresses.

SUMMARY OF THE INVENTION

In view of the above-described problems of the prior art, it is a primary object of the present invention to provide an apparatus for learn-controlling the air-fuel ratio for an internal combustion engine which is capable of promptly learning a deviation component due to a change in the air density and thereby effecting excellent learning control of the air-fuel ratio, for example, when the vehicle is going up a hill.

To this end, according to the present invention, a global learning correction coefficient for globally learning a deviation component due to a change in the air density which is mainly employed to effect altitudinal correction is set as a learning correction coefficient in addition to the area-wise learning correction coefficient, and every time the area-wise learning correction coefficients are corrected for a predetermined number of different engine running condition areas, the direction of deviations of the present area-wise learning correction coefficients in these areas from a reference value is judged. When all the area-wise learning correction coefficients have the same direction, a mean value of the deviations of the area-wise learning correction coefficients, or a minimum value among said deviations in terms of the absolute value, is calculated, and the calculated mean value or minimum value is regarded as a deviation component due to a change in the air density which may be uniformly employed for all the areas and is substituted for the global learning correction coefficient.

Thus, according to a first aspect of the present invention, there s provided an apparatus for learn controlling the air-fuel ratio which comprises the following means A to O as shown in FIG. 1:

(A) engine running condition detecting means for detecting an engine running condition including at least a parameter concerning the quantity of air which is sucked into the engine;

(B) air-fuel ratio detecting means for detecting the air-fuel ratio of the air-fuel mixture which is sucked into the engine by detecting a component of exhaust gas from the engine;

(C) basic fuel injection quantity setting means for setting a basic fuel injection quantity on the basis of the parameter detected by the engine running condition detecting means;

(D) rewritable global learning correction coefficient storing means for storing a global learning correction coefficient employed for globally correcting the basic fuel injection quantity for all the engine running condition areas;

(E) rewritable area-wise learning correction coefficient storing means for storing an area-wise learning correction coefficient employed for correcting the basic fuel injection quantity for each of the engine running condition areas;

(F) area-wise learning correction coefficient retrieving means for retrieving on the basis of an actual engine running condition an area-wise learning correction coefficient in the corresponding engine running condition area stored in the area-wise learning correction coefficient storing means;

(G) feedback correction coefficient setting means for comparing the air-fuel ratio detected by the air-fuel ratio detecting means and a target air-fuel ratio and setting a feedback correction coefficient for correcting the basic fuel injection quantity by increasing or decreasing the feedback correction coefficient by a predetermined amount so that the actual air-fuel ratio is convergent on the target air-fuel ratio;

(H) fuel injection quantity calculating means for calculating a fuel injection quantity on the basis of the basic fuel injection quantity set by the basic fuel injection quantity setting means, the global learning correction coefficient stored in the global learning correction coefficient storing means, the area-wise learning correction coefficient retrieved by the area-wise learning correction coefficient retrieving means, and the feedback correction coefficient set by the feedback correction coefficient setting means;

(I) fuel injection means for injecting fuel into the engine in an ON/OFF manner in response to a driving pulse signal which is equivalent to the fuel injection quantity calculated by the fuel injection quantity calculating means;

(J) area-wise learning correction coefficient correcting means for learning a deviation of the feedback correction coefficient from a reference value for each of the engine running condition areas and correcting as well as rewriting the corresponding area-wise learning correction coefficient stored in the area-wise learning correction coefficient storing means so that the deviation is minimized;

(K) area-wise learning progress detecting means for issuing a first global learning command every time the area-wise learning correction coefficients for a predetermined number of different engine running condition areas are corrected by the area-wise learning correction coefficient correcting means;

(L) learning direction judging means for judging the direction of deviations of the present area-wise learning correction coefficients from a reference value for a predetermined number of different engine running condition areas when the first global learning command is issued from the area-wise learning progress detecting means, and issuing a second global learning command when all the deviations have the same direction;

(M) mean value calculating means for calculating a mean value of deviations of the present area-wise learning correction coefficients from the reference value for the predetermined number of different engine running condition areas when the second global learning command is issued from the learning direction judging means;

(N) global learning correction coefficient correcting means for correcting and rewriting the global learning correction coefficient stored in the global learning correction coefficient storing means by adding the mean value calculated by the mean value calculating means to the global learning correction coefficient stored in the global learning correction coefficient storing means; and (O) second area-wise learning correction coefficient correcting means for correcting and rewriting the area-wise learning correction coefficients stored in the area-wise learning correction coefficient storing means and on the basis of which the mean value was calculated by subtracting the mean value calculated by the mean value calculating means from said area-wise learning correction coefficients.

According to a second aspect of the present invention, the above-described means M to O are replaced with the following means, respectively:

(M) minimum value calculating means for calculating a minimum value among deviations of the present area-wise learning correction coefficients from the reference value in terms of the absolute value for the predetermined number of different engine running condition areas when the second global learning command is issued from the learning direction judging means;

(N) global learning correction coefficient correcting means for correcting and rewriting the global learning correction coefficient stored in the global learning correction coefficient storing means by adding the minimum value calculated by the minimum value calculating means to the global learning correction coefficient stored in the global learning correction coefficient storing means; and (O) second area-wise learning correction coefficient correcting means for correcting and rewriting the area-wise learning correction coefficients stored in the area-wise learning correction coefficient storing means and on the basis of which the minimum value was calculated by subtracting the minimum value calculated by the minimum value calculating means from said area-wise learning correction coefficients.

As described above, the basic fuel injection quantity setting means C sets a basic fuel injection quantity corresponding to a target air-fuel ratio on the basis of a parameter concerning the quantity of air which is sucked into the engine; the area-wise learning correction coefficient retrieving means F retrieves an area-wise learning correction coefficient for an area corresponding to an actual engine running condition from the area-wise learning correction coefficient storing means E; and the feedback correction coefficient setting means G compares an actual air-fuel ratio and a target airfuel ratio with each other and sets a feedback correction coefficient by increasing or decreasing it by a predetermined amount on the basis of, for example, proportional plus integral control, so that the actual air-fuel ratio is convergent on the target air-fuel ratio. The fuel injection quantity calculating means H corrects the basic fuel injection quantity by the global learning correction coefficient stored in the global learning correction coefficient storing means D, corrects the corrected basic fuel injection quantity by the area-wise learning correction coefficient, and further corrects the corrected basic fuel injection quantity by the feedback correction coefficient, thereby calculating a fuel injection quantity. The fuel injection means I is activated in response to a driving pulse signal which is equivalent to the calculated fuel injection quantity.

On the other hand, the area-wise learning correction coefficient correcting means J learns a deviation of the feedback correction coefficient from a reference value for each of the engine running condition areas, and corrects the area-wise learning correction coefficient corresponding to each engine running condition area so that the deviation is minimized, and then rewrites the data stored in the area-wise learning correction coefficient storing means E. In this way, variations in parts and the like, including a deviation component due to a change in the air density, are learned for each area.

Every time the area-wise learning correction coefficients for a predetermined number of different engine running condition areas are corrected, this is detected by the area-wise learning progress detecting means K. Then, the learning direction judging means L judges whether or not all the deviations of the present area-wise learning correction coefficients for the predetermined number of different engine running condition areas from a reference value have the same direction. If all the deviations have the same direction, it is considered that a deviation component due to a change in the air density has been learned, and the mean value calculating means or minimum value calculating means M calculates a mean value of deviations of the present area-wise learning correction coefficients from the reference value for the predetermined number of different engine running condition areas, or a minimum value among the deviations in terms of the absolute value. Upon the completion of this calculation, the global learning correction coefficient correcting means N adds the mean or minimum value to the global learning correction coefficient stored in the global learning correction coefficient storing means D to thereby rewrite the data stored in the global learning correction coefficient storing means D. Thus, the above-described mean or minimum value is regarded as a deviation component due to a change in the air density which may uniformly be employed for all the areas and is substituted for the global learning correction coefficient. Contrarily, the second area-wise learning correction coefficient correcting means 0 rewrites the data stored in the area-wise learning correction coefficient storing means E by subtracting the mean or minimum value from each of the area-wise learning correction coefficients on the basis of which the mean or minimum value was calculated. In this way, variations in parts and the like other than the deviation component due to a change in the air density are left included in the area-wise learning correction coefficients.

The above and other objects, features and advantages of the present invention will become clear from the following description of the preferred embodiments taken in conjunction with the accompanying drawings.

DETAILED DESCRIPTION OF THE PREFERRED EMBODIMENTS

Preferred embodiments of the present invention will be described hereinunder in detail with reference to the accompanying drawings.

Figure 1:
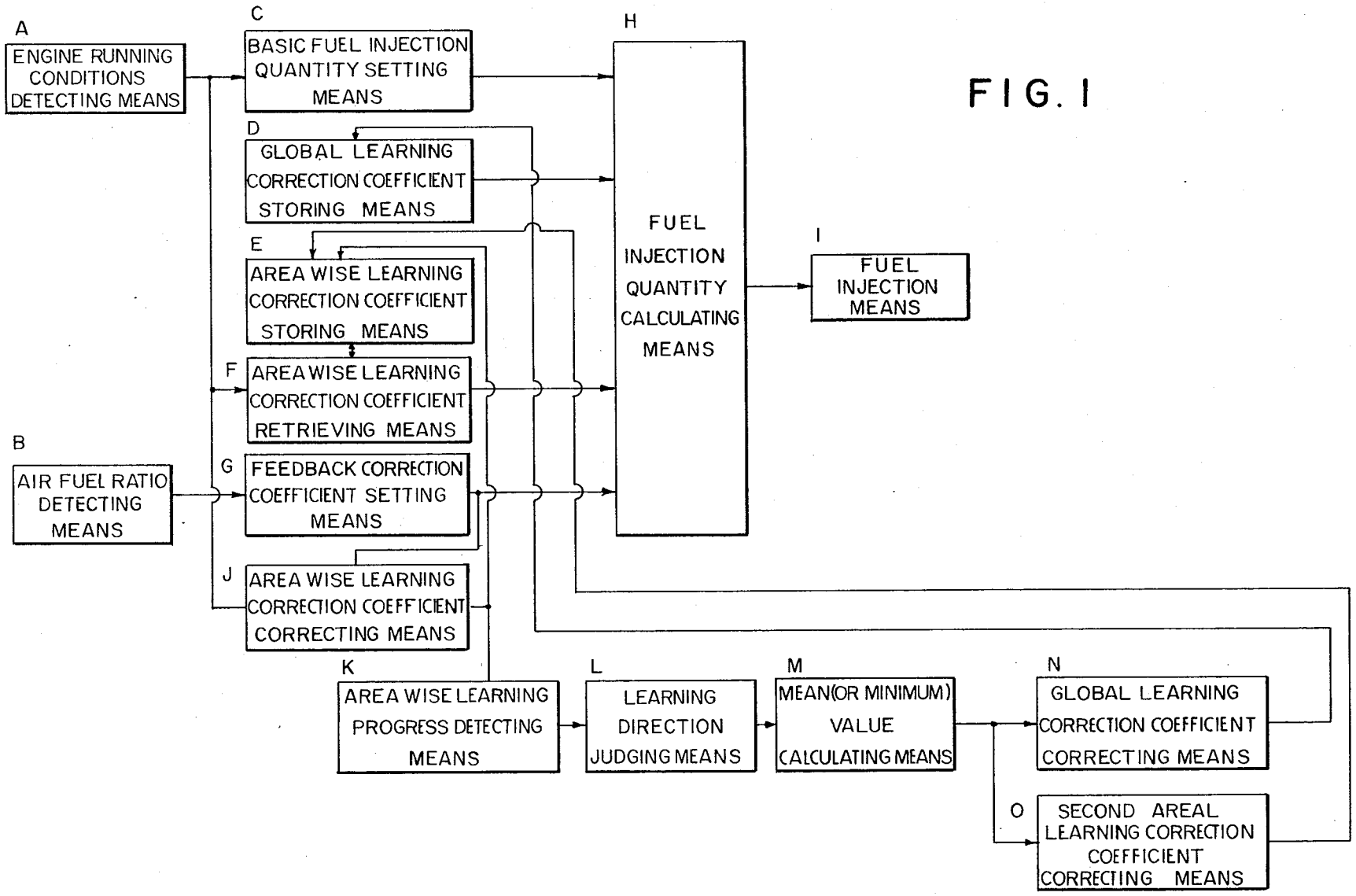
FIG. 1 is a block diagram showing the arrangement of the present invention.
Figure 2:
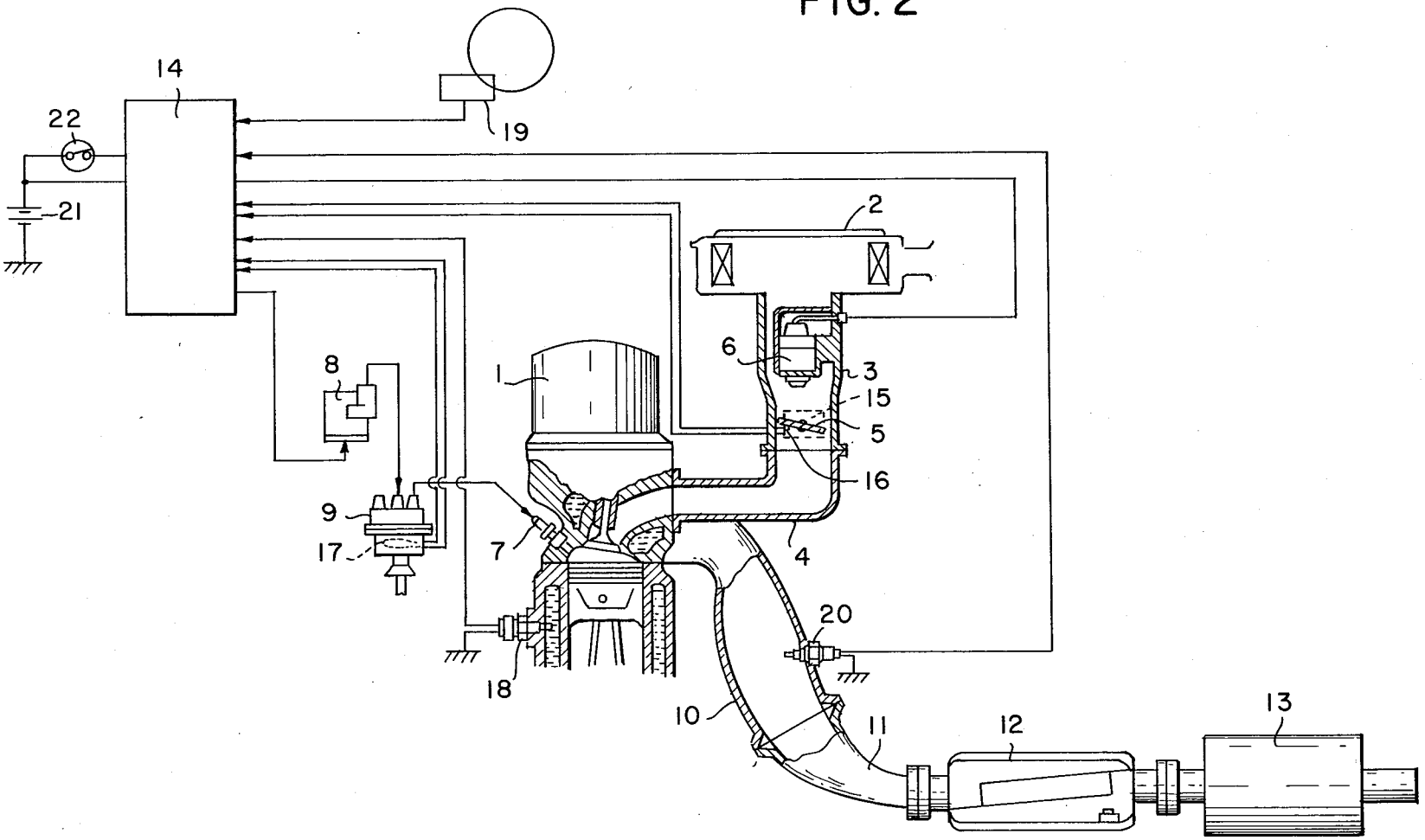
FIG. 2 shows a system in accordance with one embodiment of the present invention.

Referring first to FIG. 2, air is sucked into an engine 1 through an air cleaner 2, a throttle body 3 and an intake manifold 4.

The throttle body 3 is provided therein with a throttle valve 5 which is interlocked with an accelerator pedal (not shown). In addition, a fuel injection valve 6 which serves as fuel injection means is provided inside the throttle body 3 and at the upstream side of the throttle valve 5. The fuel injection valve 6 is an electromagnetic fuel injection valve which is opened when a solenoid is energized and which is closed when the energization is suspended. More specifically, when the solenoid is energized in response to a driving pulse signal delivered from a control unit 14 (described later in detail), the fuel injection valve 6 is opened to inject fuel which has been supplied from a fuel pump (not shown) and adjusted to a predetermined pressure by means of a pressure regulator. It should be noted that, although in this embodiment the present invention is applied to a single-point injection system, the invention is also applied to a multipoint injection system in which a fuel injection valve is provided at the branch portion of the intake manifold or the intake port of the engine for each cylinder.

An ignition plug 7 is provided so as to extend into the combustion chamber of the engine 1. A high voltage which is generated in an ignition coil 8 on the basis of an ignition signal delivered from the control unit 14 is applied to the ignition plug 7 through a distributor 9, thereby causing spark ignition and thus burning an air-fuel mixture.

Exhaust is discharged from the engine 1 through an exhaust manifold 10, an exhaust duct 11, a ternary catalyst 12, and a muffler 13.

The control unit 14 has a microcomputer which comprises a CPU, ROM, RAM, A/D converter and an input/output interface. The control unit 14 is supplied with input signals delivered from various kinds of sensor and adapted to arithmetically process the input signals to control the operations of the fuel injection valve 6 and the ignition coil 8, as described later.

The above-described various kinds of sensors include a potentiometer-type throttle sensor 15 which is provided at the throttle valve 5 to output a voltage signal corresponding to the degree $\alpha$ of opening of the throttle valve 5. The throttle sensor 15 is provided therein with an idle switch 16 which is turned ON when the throttle valve 5 is at the fully-opened position.

A crank angle sensor 17 is incorporated in the distributor 9 to output a position signal which is generated every crank angle of 2° and a reference signal generated every crank angle of 180° (in the case of a four-cylinder engine). The engine speed N can be computed by measuring the number of pulses of the position signal which are generated per unit of time, or by measuring the period of the reference signal.

Further provided are water temperature sensor 18 for detecting the engine cooling water temperature Tw, a vehicle speed sensor 19 for detecting the vehicle speed VSP, etc.

The throttle sensor 15, the crank angle sensor 17, etc. constitute in combination engine running condition detecting means.

An $O_2$ sensor 20 is provided so as to extend into the inside of the exhaust manifold 10. The $O_2$ sensor 20 is a known type of sensor in which the electromotive force changes suddenly with the boundary condition that the air-fuel mixture is burned near a stoichiometric air-fuel ratio which is a target air-fuel ratio. Accordingly, the $O_2$ sensor 20 constitutes air-fuel ratio (rich or lean) detecting means.

Further, a battery 21 which serves as a power supply for operating the control unit 14 and which is also used to detect a power supply voltage is connected to the control unit 14 through an engine key switch 22. The battery 21 also serves as a power supply for operating the RAM in the control unit 14. In order to enable the storage contents to be held even after the engine key switch 22 has been turned OFF, the battery 21 is connected to the RAM through an appropriate stabilizing power supply without being passed through the engine key switch 22.

The CPU which constitutes a part of the microcomputer incorporated in the control unit 14 controls fuel injection by carrying out arithmetic processings according to programs (fuel injection quantity calculating routine, feedback control zone judging routine, proportional plus integral control routine, first learning control, and second learning control) stored in the ROM which are shown in flowcharts of FIGS. 3 to 7. The functions of the CPU by which it serves as the following various means are attained by the aforementioned programs: i.e., basic fuel injection quantity setting means; area-wise learning correction coefficient retrieving means; feedback correction coefficient setting means; fuel injection quantity calculating means; area-wise learning correction coefficient correcting means; area-wise learning progress detecting means; learning direction judging means; mean value calculating means; global learning correction coefficient correcting means; and second area-wise learning correction coefficient correcting means. The RAM is employed to serve as both global learning correction coefficient storing means and area-wise learning correction coefficient storing means.

The arithmetic processings executed by the microcomputer incorporated in the control unit 14 will next be described with reference to the flowcharts shown in FIGS. 3 to 7.

Figure 3:
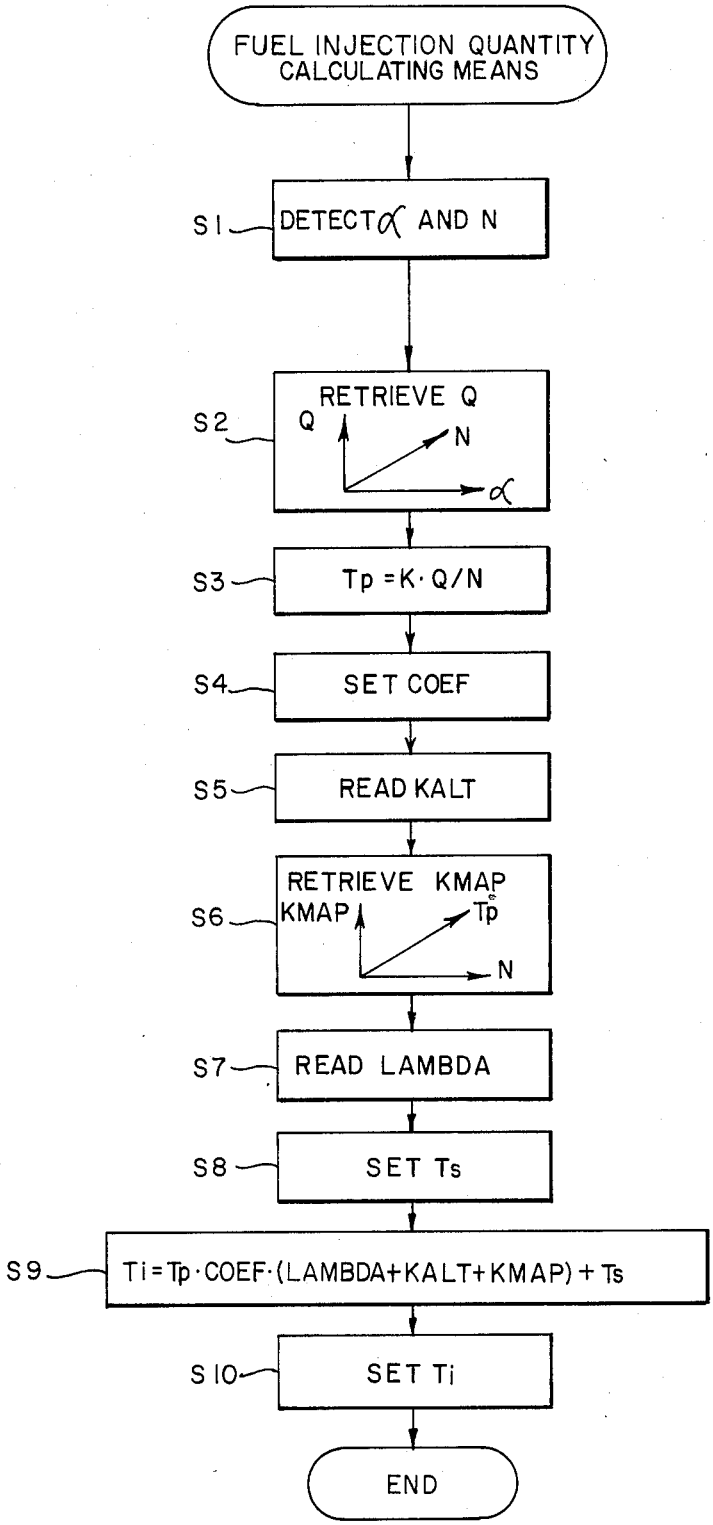
FIGS. 3 to 7 are flowcharts showing the contents of various arithmetic processings, respectively.

In the fuel injection quantity calculating routine shown in FIG. 3, a throttle valve opening o detected on the basis of the signal delivered from the throttle sensor 15 and an engine speed N calculated on the basis of the signal from the crank angle sensor 17 are read in Step 1 (in the figure, "Step 1" is denoted by "S1"; the same rule applies to the followings).

In Step 2, an intake air flow rate Q in accordance with the throttle valve opening $\alpha$ and the engine speed N is read by retrieving Q corresponding to the actual $\alpha$ and N with reference to a map which has previously been obtained by experiments or the like and stored in the ROM.

In Step 3, a basic fuel injection quantity Tp which corresponds to the intake air quantity per unit engine speed is calculated from the intake air flow rate Q and the engine speed N, i.e., $Tp = K. Q/N$ (K is a constant). Steps 1 to 3 correspond in combination to the basic fuel injection quantity setting means.

Various correction coefficients COEF are set in Step 4. The correction coefficients COEF include: an acceleration correction coefficient which is obtained on the basis of the rate of change of the throttle valve opening $\alpha$ detected on the basis of the signal from the throttle sensor 15 or which is given in response to the change-over of the idle switch 16 from the ON state to the OFF state; a water temperature correction coefficient in accordance with the engine cooling water temperature Tw detected on the basis of the signal delivered from the water temperature sensor 18; a mixture ratio correction coefficient which is obtained in accordance with the engine speed N and the basic fuel injection quantity (load) Tp; etc.

In Step 5, a global learning correction coefficient $K_{ALT}$ is read which has been stored at a predetermined address in the RAM serving as the global learning correction coefficient storing means. It should be noted that, when the learning has not yet been started, an initial value 0 is read as the global learning correction coefficient $K_{ALT}$.

In Step 6, an area-wise learning correction coefficient $K_{MAP}$ which corresponds to the actual engine speed N and basic fuel injection quantity (load) Tp is read by effecting retrieval with reference to a map which shows learning correction coefficients $K_{MAP}$ set in correspondence to the engine speed N and the basic fuel injection quantity (load) Tp that represent an engine running condition, the map being stored in the RAM which serves as the areawise learning correction coefficient storing means. This portion of the program corresponds to the areawise learning correction coefficient retrieving means. It should be noted that the map of the area-wise learning correction coefficients $K_{MAP}$ is formed such that the engine speed N is plotted along the axis of abscissa, while the basic fuel injection quantity Tp is plotted along the axis of ordinate, and engine running conditions are divided in the form of a lattice consisting of about 8×8 areas each having an area-wise learning correction coefficient $K_{MAP}$ stored therein. When the learning control has not yet been started, all the areas have an initial value 0 stored therein.

In Step 7, a feedback correction coefficient LAMBDA is read which is set in accordance with the proportional plus integral control routine shown in FIG. 5 (described later). It should be noted that the reference value for the feedback correction coefficient LAMBDA is 1.

In Step 8, a voltage correction coefficient Ts is set on the basis of the voltage value of the battery 21. This is effected for the purpose of correcting a change in the injection flow rate determined by the fuel injection valve which change is attributed to fluctuations in the battery voltage.

In Step 9, a fuel injection quantity Ti is calculated according to the following equation. This portion of the program corresponds to the fuel injection quantity calculating means:

$$Ti = Tp.COEF.(LAMBDA + K_{ALT} + K_{MAP}) + T_s$$

In Step 10, the resultant Ti is set in an output register. Thus, a driving pulse signal having a pulse width corresponding to Ti is applied to the fuel injection valve 6 to effect fuel injection at a predetermined fuel injection timing which is synchronized with the revolution of the engine (e.g. every ½ revolution).

Figure 4:
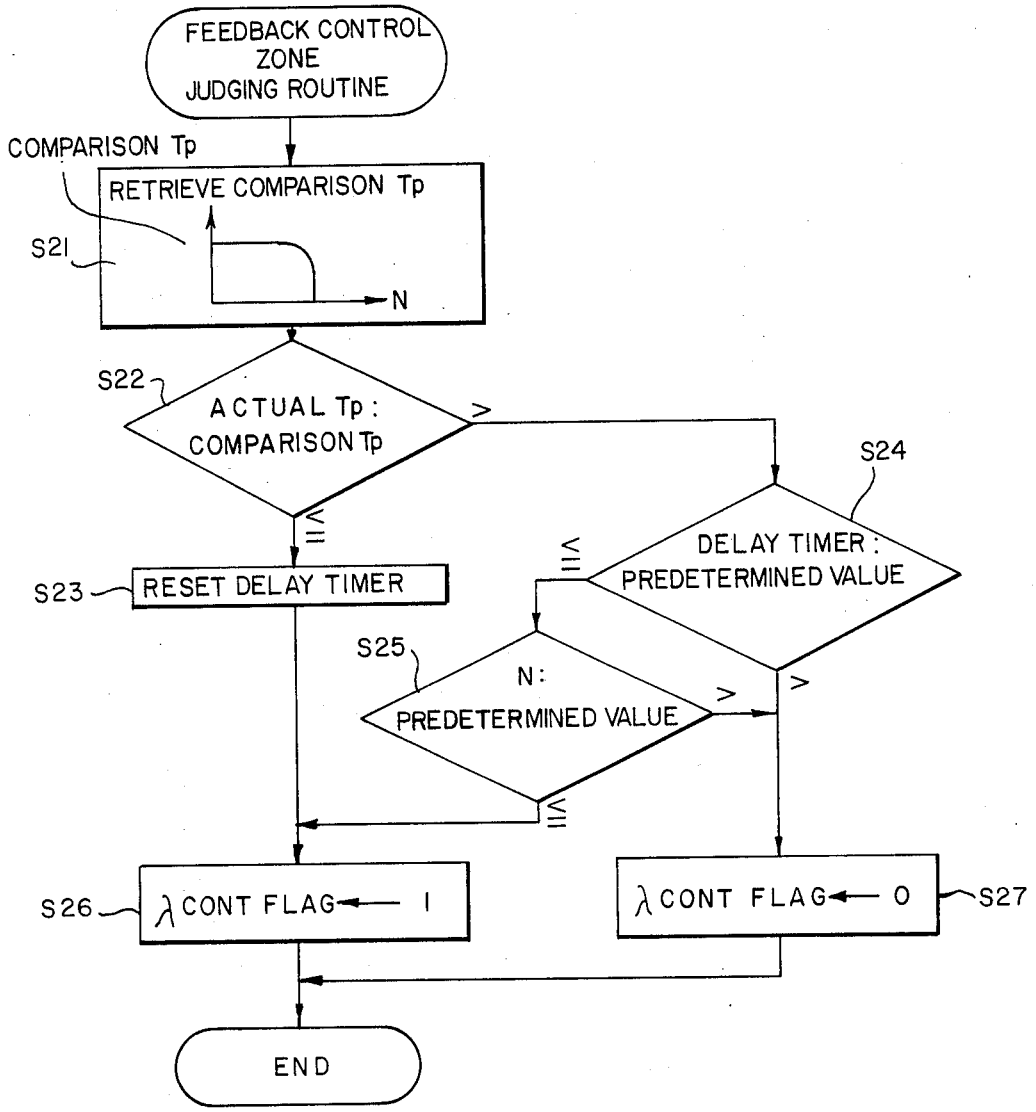

FIG. 4 shows the feedback control zone judging routine which is employed in principle to effect feedback control of the air-fuel ratio in the case where the engine is running at low speed and under light load and to suspend the air-fuel ratio feedback control in the case of high speed or heavy load.

A comparison basic fuel injection quantity Tp is retrieved from the engine speed N in Step 21 and compared with an actual basic fuel injection quantity Tp.

If the actual basic fuel injection quantity Tp is equal to or smaller than the comparison quantity Tp, that is, if the engine is running at low speed and under light load, the process proceeds to Step 23 in which a delay timer (which is activated to count up in response to a clock signal) is reset, and the process proceeds to Step 26 in which a "λ cont" flag is set to "1". The intention of this process is to effect feedback control of the air-fuel ratio in the case where the engine is running at low speed and under light load.

If the actual basic fuel injection quantity Tp is greater than the comparison quantity Rp, that is, if the engine is running at high speed or under heavy load, the process, in principle, proceeds to Step 27 in which the "λ cont" flag is reset to "0". The intention of this process is to suspend the air-fuel ratio feedback control and to obtain a rich output air-fuel ratio separately, thereby suppressing the rise in temperature of exhaust, and thus preventing seizing of the engine 1 and damage to the catalyst 12 by a fire.

In accordance with this embodiment, even when the engine is running at high speed or under heavy load, the air-fuel ratio feedback control is not immediately suspended but continued for a predetermined period of time. More specifically, the value of the delay timer is compared with a predetermined value in Step 24 so that the process proceeds to Step 26 to continuously set the "λ cont" flag to "1" to thereby continue the air-fuel ratio feedback control until a predetermined period of time (e.g., 10 seconds) has elapsed after the engine running condition has shifted to high speed or heavy load. The intention of this process is to increase the number of opportunities to learn a deviation component due to a change in the air density since the hill climbing operation of the engine is carried out within the heavy load region. However, when it is judged in Step 25 that the engine speed N exceeds a predetermined value (e.g., 3800 rpm) or the state wherein said predetermined value is exceeded has continued for a predetermined period of time, the air-fuel ratio feedback control is suspended for the purpose of ensuring safety.

Figure 5:
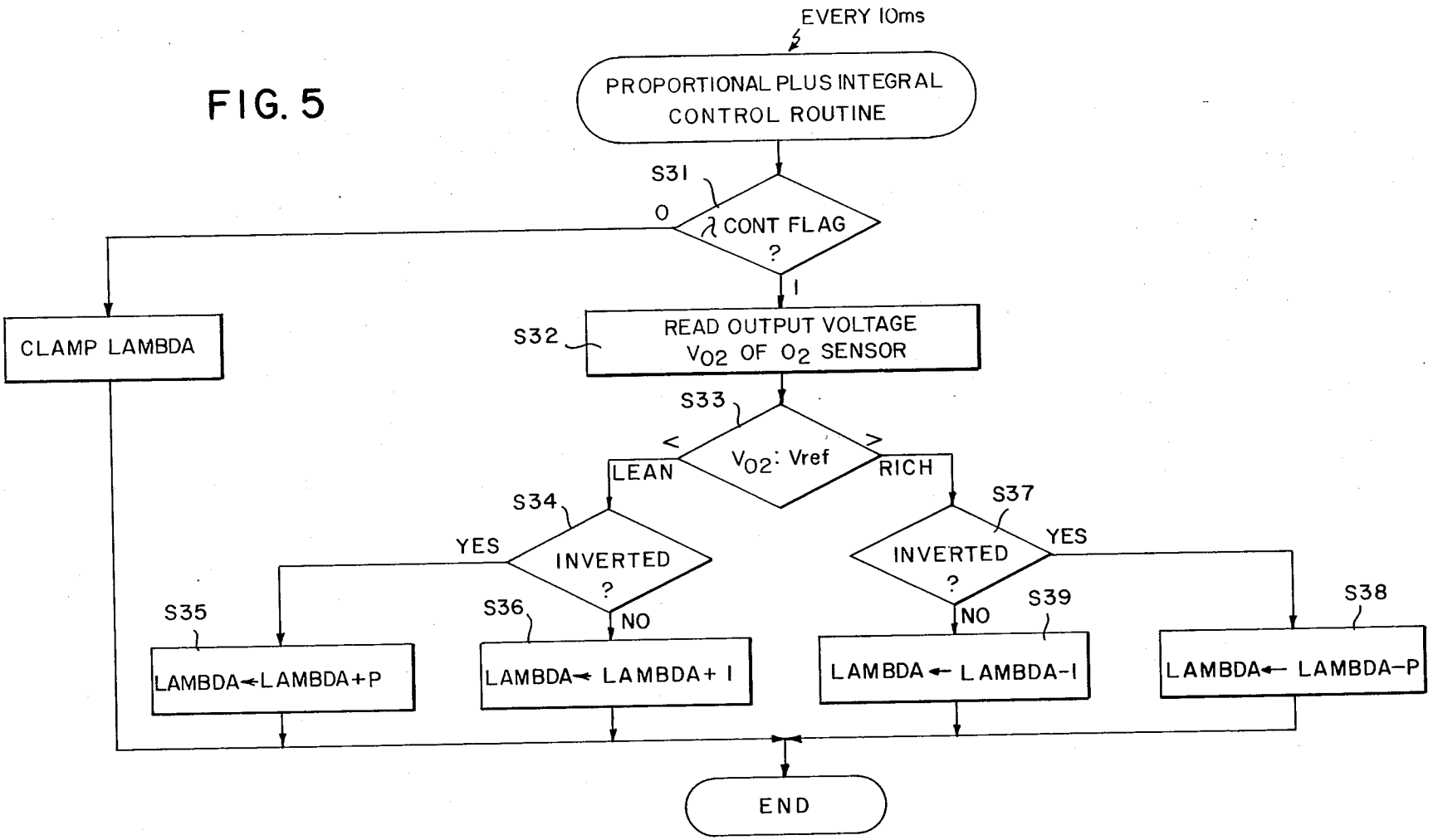

FIG. 5 shows the proportional plus integral control routine which is executed every predetermined period of time (e.g., 10 ms) to thereby set a feedback correction coefficient LAMBDA. Accordingly, this routine corresponds to the feedback correction coefficient setting means.

In Step 31, the value of the "λ cont" flag is judged, and if the value is 0, the routine is ended. In this case, the feedback correction coefficient LAMBDA is clamped so as to be a previous value (or the reference value 1), and the air-fuel ratio feedback control is thus suspended.

If the value of the "λ cont" flag is 1, the process proceeds to Step 32 in which the output voltage $V_{O2}$ of the $O_2$ sensor 20 is read, and the output voltage $V_{O2}$ is compared with a slice level voltage $V_{ref}$ corresponding to a stoichiometric air-fuel ratio in Step 33, thereby judging whether the air-fuel ratio is rich or lean.

When the air-fuel ratio is lean ($V_{O2} < V_{ref}$), the process proceeds from Step 33 to Step 34 in which a judgment is made as to whether or not the air-fuel ratio has just changed from the rich side to the lean side. If YES, the process proceeds to Step 35 in which the feedback correction coefficient LAMBDA is increased by an amount which corresponds to a predetermined proportional constant P with respect to a previous value. If NO is the answer in Step 34, the process proceeds to Step 36 in which the feedback correction coefficient LAMBDA is increased by an amount corresponding to a predetermined integration constant I with respect to a previous value. Thus, the feedback correction coefficient LAMBDA is increased with a predetermined gradient. It should be noted that P>>I.

When the air-fuel ratio is rich ($V_{O2} > V_{ref}$), the process proceeds from Step 33 to Step 37 in which a judgment is made as to whether or not the air-fuel ratio has just changed from the lean side to the rich side. If YES, the process proceeds to Step 38 in which the feedback correction ccefficient LAMBDA is decreased by an amount corresponding to a predetermined proportional constant P with respect to a previous value. If NO is the answer in Step 38, the process proceeds to Step 39 in which the feedback correction coefficient LAMBDA is decreased by an amount corresponding to a predetermined integration constant I with respect to a previous value. In this way, the feedback correction coefficient LAMBDA is decreased with a predetermined gradient.

Figure 6:
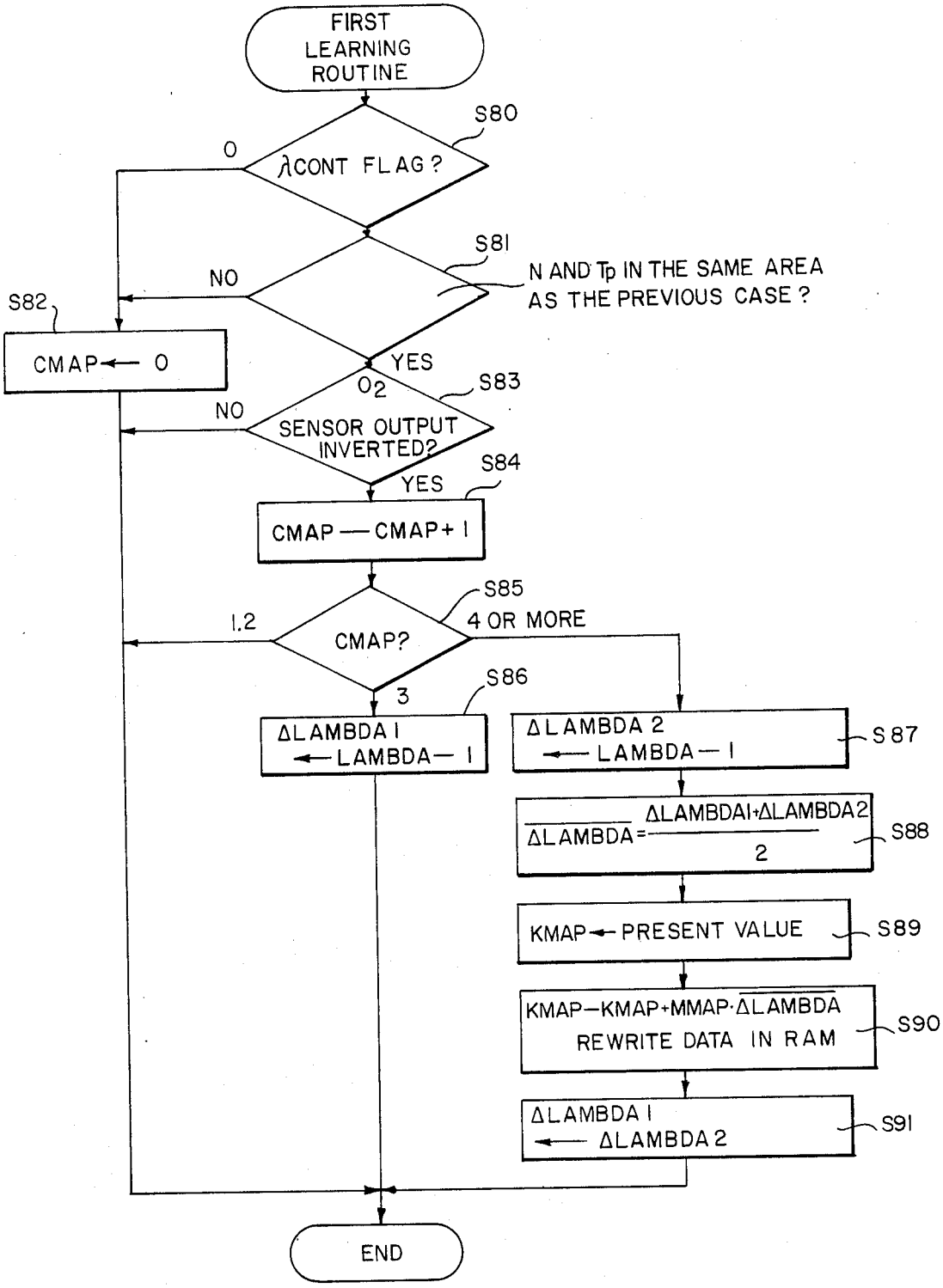

FIG. 6 shows the first learning routine. This routine corresponds to the area-wise learning correction coefficient correcting means.

In Step 80, the value of the "λ cont" flag is judged. If the value is 0, the process proceeds to Step 82 in which a count value $C_{MAP}$ is cleared, and the routine is then ended. This is because learning cannot be carried out when the air-fuel ratio feedback control is suspended.

When the value of the "λ cont" flag is 1, that is, when the air-fuel ratio feedback control is being effected, the process proceeds to Step 81.

In Step 81, a judgment is made as to whether or not the engine speed N and the basic fuel injection quantity Tp, which represent an engine running condition, are within the same area as in the previous case. If NO, the process proceeds to Step 82 in which the count value $C_{MAP}$ is cleared, and this routine is then ended.

If YES is the answer in Step 81, that is, if the engine speed N and the basic fuel injection quantity Tp are in the same area as in the previous case, it is judged in Step 83 whether or not the output of the $O_2$ sensor 20 has inverted, that is, whether or not the direction in which the feedback correction coefficient LAMBDA increases or decreases has inverted. Every time this routine is repeated to find that the increase or decrease direction of the feedback correction coefficient LAMBDA has inverted, the count value $C_{MAP}$ which represents the number of times of inversion is incremented by one in Step 84. When the count value $C_{MAP}$ reaches, for example, 3, the process proceeds from Step 85 to Step 86 in which a deviation (LAMBDA-1) of the present feedback correction coefficient LAMBDA from the reference value 1 is temporarily stored in the form of $\Delta LAMBDA_1$, and learning is thus started.

Figure 8:
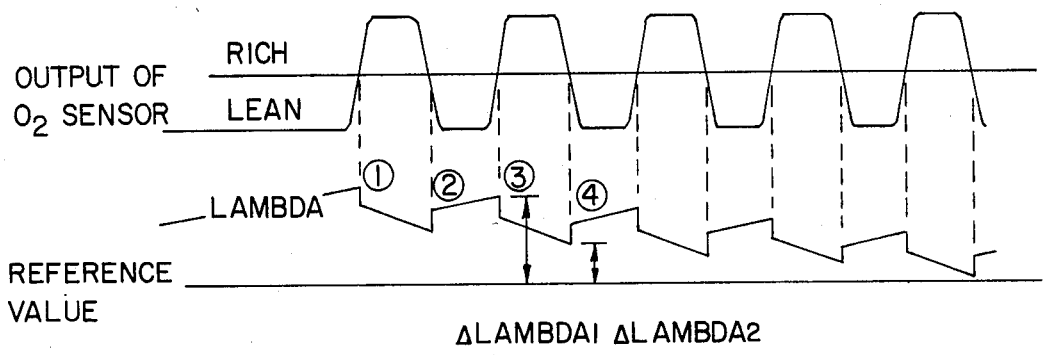
FIG. 8 shows the way in which the feedback correction coefficient changes.

When the count value $C_{MAP}$ becomes 4 or more, the process proceeds from Step 85 to Step 87 in which a deviation (LAMBDA-1) of the present feedback correction coefficient LAMBDA from the reference value 1 is temporarily stored in the form of $\Delta LAMBDA_2$. The $\Delta LAMBDA_1$ and $\Delta LAMBDA_2$ thus stored respectively represent the upper and lower peak values of deviation of the feedback correction coefficient LAMBDA from the reference value 1 during the time interval from the previous (e.g., the third) inversion to the present (e.g., the fourth) inversion, as shown in FIG. 8.

After the upper and lower peak values $LAMBDA_1$ and $\Delta LAMBDA_2$ of deviation of the feedback correction coefficient LAMBDA from the reference value 1 have been obtained in this way, the process proceeds to Step 88 in which a mean value $\overline{\Delta LAMBDA}$ of these peak values is obtained.

Then, the process proceeds to Step 89 in which an area-wise learning correction coefficient $K_{MAP}$ (the initial value thereof is 0) which has been stored on the map in the RAM in correspondence with the present area is read out by retrieval.

Then, the process proceeds to Step 90 in which the mean value $\overline{\Delta LAMBDA}$ of deviation of the feedback correction coefficient from the reference value is added to the present area-wise learning correction coefficient $K_{MAP}$ at a predetermined rate according to the following equation, thereby calculating a new area-wise learning correction coefficient $K_{MAP}$, and thus correcting and rewriting the area-wise learning correction coefficient data in the same area on the map stored in the RAM:

$$K_{MAP} \leftarrow K_{MAP} + M_{MAP} \cdot \overline{\Delta LAMBDA}$$

($M_{MAP}$ is an addition rate constant; $0 < M_{MAP} < 1$)

Thereafter, $\Delta LAMBDA_2$ is substituted for $\Delta LAMBDA_1$ for the subsequent learning in Step 91.

Figure 7:
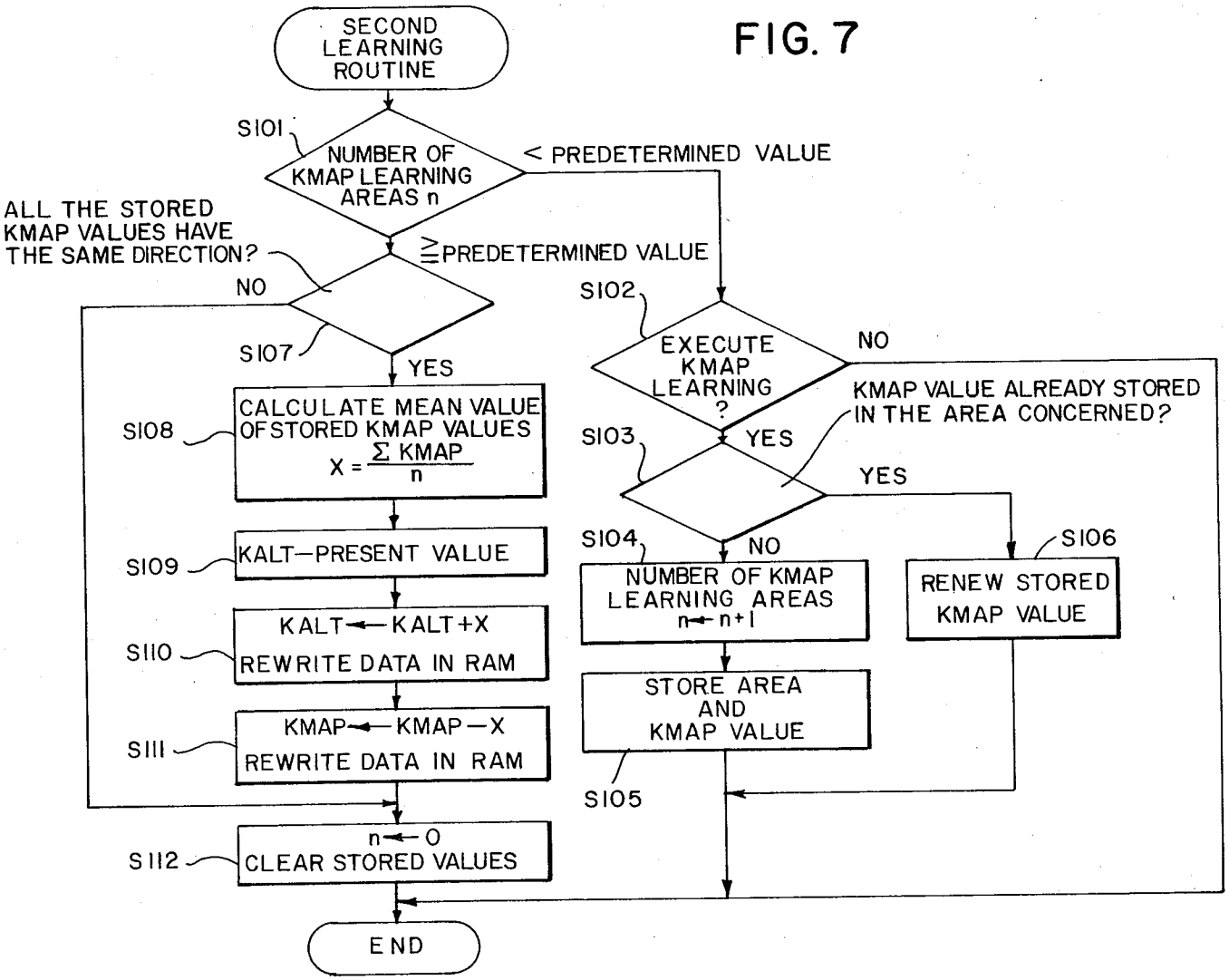

FIG. 7 shows the second learning routine. This routine functions as the area-wise learning progress detecting means, learning direction judging means, mean value calculating means, global learning correction coefficient correcting means, and second area-wise learning correction coefficient correcting means.

It is judged in Step 101 whether or not the number of areas n where learning as to the area-wise learning correction coefficient $K_{MAP}$ (hereinafter referred to as the "$K_{MAP}$ learning") has already been effected reaches a predetermined value (e.g., 3 or 4). If the number of areas n is less than the predetermined value, the process proceeds to Step 102. It is judged in Step 102 whether or not the $K_{MAP}$ learning (i.e., Step 90 shown in FIG. 6) has already been executed for the area concerned. If YES, the process proceeds to Step 103 in which a judgment is made as to whether or not a $K_{MAP}$ value has already been stored in said area. If NO, that is, if said area is a new area, the number of areas n in which the $K_{MAP}$ learning has already been executed is incremented by one in Step 104, and said area and the $K_{MAP}$ value are stored in Step 105. If a $K_{MAP}$ value has already been stored for the area concerned, the stored $K_{MAP}$ value is renewed in Step 106.

When the number of $K_{MAP}$ learning areas n reaches the predetermined value, the process proceeds from Step 101 to Step 107 and the following Steps. Accordingly, Step 101 corresponds to the area-wise learning progress detecting means.

It is judged in Step 107 whether or not all the n $K_{MAP}$ values stored in the above-described Step 105 or renewed in Step 106 have the same direction, that is, whether or not all the n $K_{MAP}$ values have the same sign, i.e., the positive or negative sign. If NO, it is considered that variations in parts are being learned, and this routine is ended. If YES is the answer in Step 107 (i.e., if all the n $K_{MAP}$ values are positive or negative), it is considered that a deviation component due to a change in the air density is being learned, and the process proceeds to Step 108 and the following Steps. Step 107 corresponds to learning direction judging means. It should be noted that, although the judgment is originally made as to the deviation of the $K_{MAP}$ value from the reference value, since in this embodiment the reference value is set to 0, the $K_{MAP}$ itself is judged. The same is the case with the calculation of the mean value (described later).

In Step 108, the sum total $\Sigma K_{MAP}$ of stored n $K_{MAP}$ values is calculated and divided by n to obtain a mean value $X = \Sigma K_{MAP}/n$. Step 108 corresponds to the mean value calculating means, and the mean value X obtained in this Step is regarded as a deviation component due to a change in the air density which may uniformly be employed for all the areas.

Then, the process proceeds to Step 109 in which the present global learning correction coefficient $K_{ALT}$ (the initial value thereof is 0) stored at a predetermined address in the RAM is read out.

The process then proceeds to Step 110 in which the mean value X is added to the present global learning correction coefficient $K_{ALT}$ according to the following equation to calculate a new global learning correction coefficient $K_{ALT}$ with which the global learning correction coefficient data stored at the predetermined address in the RAM is corrected and thereby rewritten. Step 110 corresponds to the global learning correction coefficient correcting means:

$$K_{ALT} \leftarrow K_{ALT} + X$$

Then, the process proceeds to Step 111 in which the mean value X is subtracted from the areawise learning correction coefficient $K_{MAP}$ stored in each of the areas on the basis of which the mean value X was calculated, according to the following equation, thereby calculating a new area-wise learning correction coefficient $K_{MAP}$, and thus correcting and rewriting the area-wise learning correction coefficient stored in the same area on the map in the RAM. Step 111 corresponds to the second area-wise learning correction coefficient correcting means:

$$K_{MAP} \leftarrow K_{MAP} - X$$

Then, the process proceeds to Step 112 in which the number of KMAP learning areas n is cleared, and the other stored values are also cleared.

Thus, every time the number of areas which have been subjected to the $K_{MAP}$ learning (renewal of the $K_{MAP}$ value) reaches a predetermined value, the direction of the area-wise learning correction coefficients renewed meantime is judged, and when all the renewed area-wise learning correction coefficients have the same direction or sign, a mean value of them is calculated and regarded as a deviation component due to a change in the air density which may uniformly be employed for all the areas, and the mean value is substituted for the global learning correction coefficient.

Figure 9:
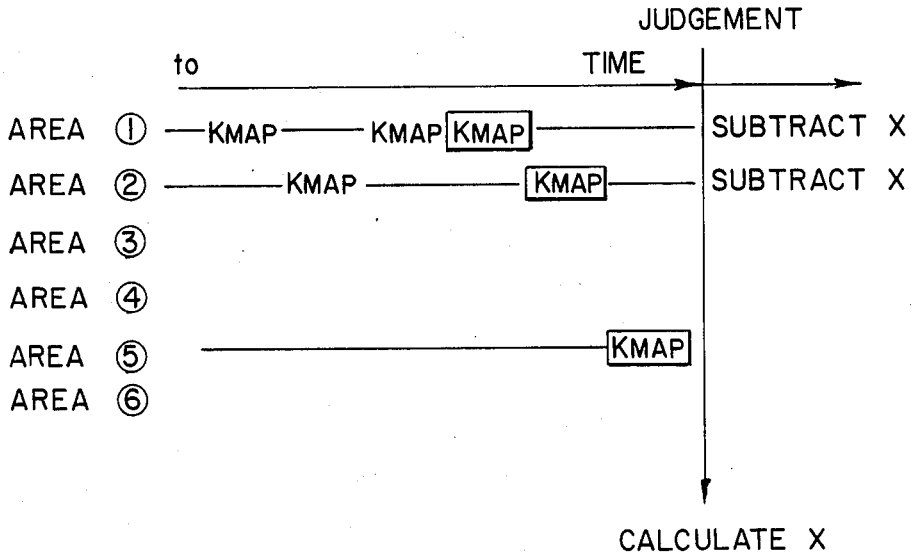
FIG. 9 shows the timing at which the global learning correction coefficient is learned.

If it is assumed that the area-wise learning correction coefficients $K_{MAP}$ in the areas 1, 2 and 5 have been rewritten in the following sequence from the time $t_O$, that is, ① - ② - ① - ① -② - ⑤ as exemplarily shown in FIG. 9, and the aforementioned predetermined number is 3, then at the time the correction coefficient $K_{MAP}$ in the area ⑤ has been rewritten, the direction of the newest $K_{MAP}$ va in the areas ①, ② and ⑤ is judged. If all the $K_{MAP}$ values have same direction (e.g., all of them are negative), a mean value X of these values is calculated to set a global learning correction coefficient $K_{ALT}$, and X is subtracted from each of the $K_{MAP}$ values in the areas 1, 2 and 5.

It should be noted that, if the minimum value is employed in place of the mean value, the minimum value among the n stored $K_{MAP}$ values in terms of the absolute value is selected in Step 108 shown in FIG. 7 (e.g., if the $K_{MAP}$ values are −0.08, −0.04 and −0.05, respectively, −0.04 is selected), and the selected value is employed as X to execute the following processings. The minimum value is employed to regard the air density as having changed at least by an amount corresponding to this minimum value.

Another embodiment of the present invention will be described next.

In this embodiment, a deviation component due to a change in the air density is globally learned under such conditions that a deviation component due to a change in the air density alone can be learned, that is, in an engine operation region (the hatched portion in FIG. 13) wherein the intake air flow rate has substantially no change in accordance with the change in the degree of opening of the throttle valve for each of the engine speeds and wherein there are no variations among systems with respect to the change in the degree of opening of the throttle valve, thereby rewriting the global learning correction coefficient. In other regions, variations in parts or the like are learned for each area to rewrite the area-wise learning correction coefficient, and then the second learning routine shown in FIG. 7 is executed.

Figure 10:
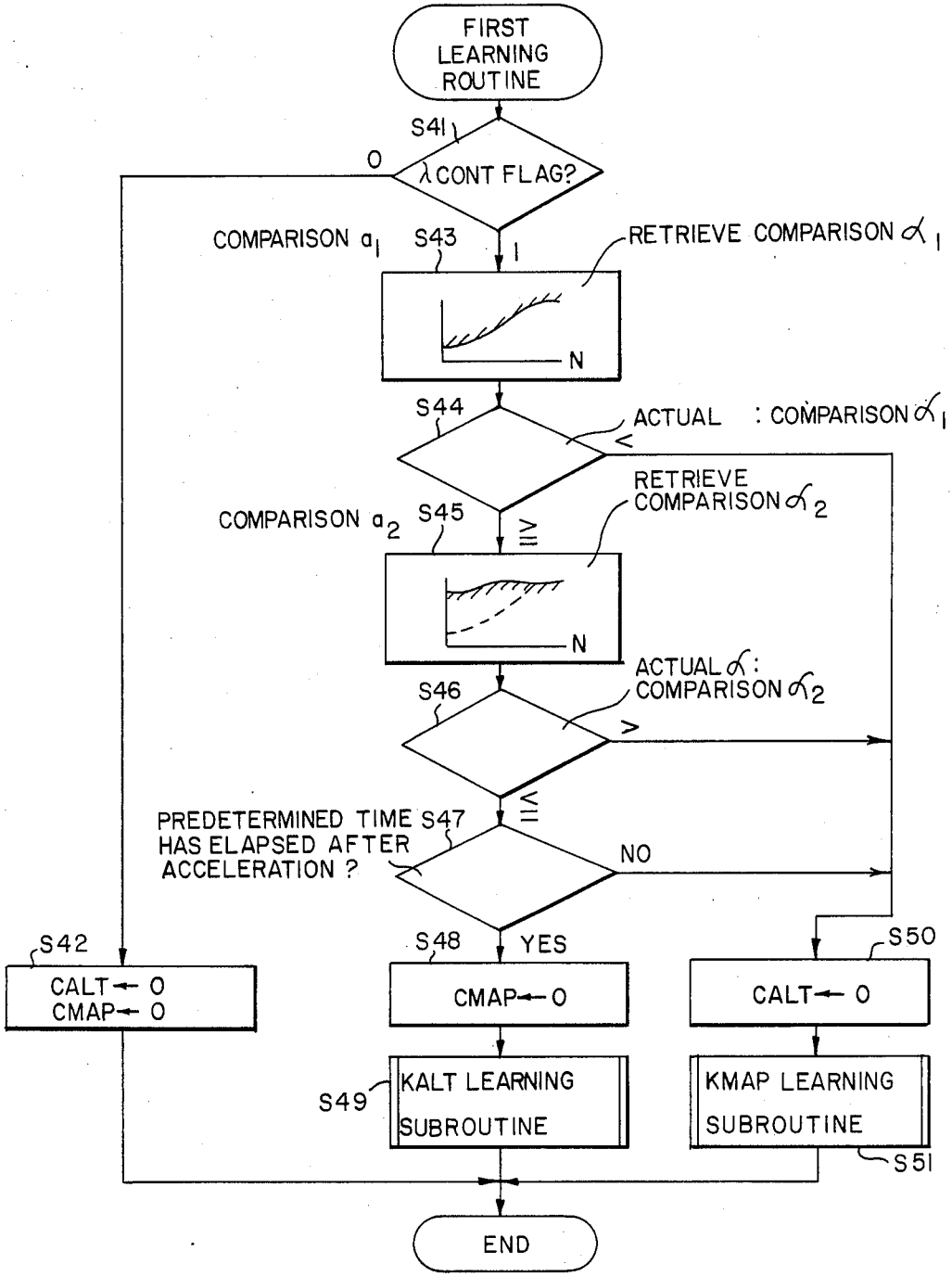
FIGS. 10 to 12 are flowcharts showing the contents of arithmetic processings in accordance with another embodiment of the present invention which may replace the arithmetic processing shown in FIG. 6.
Figure 11:
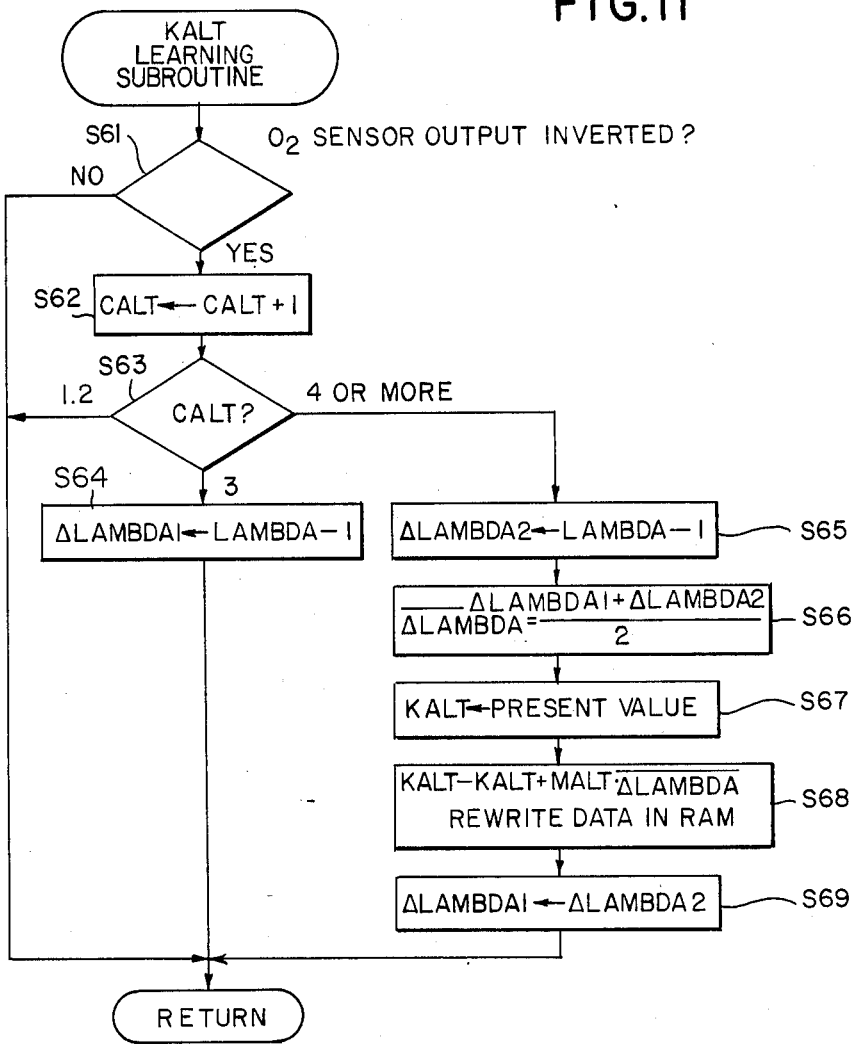
Figure 12:
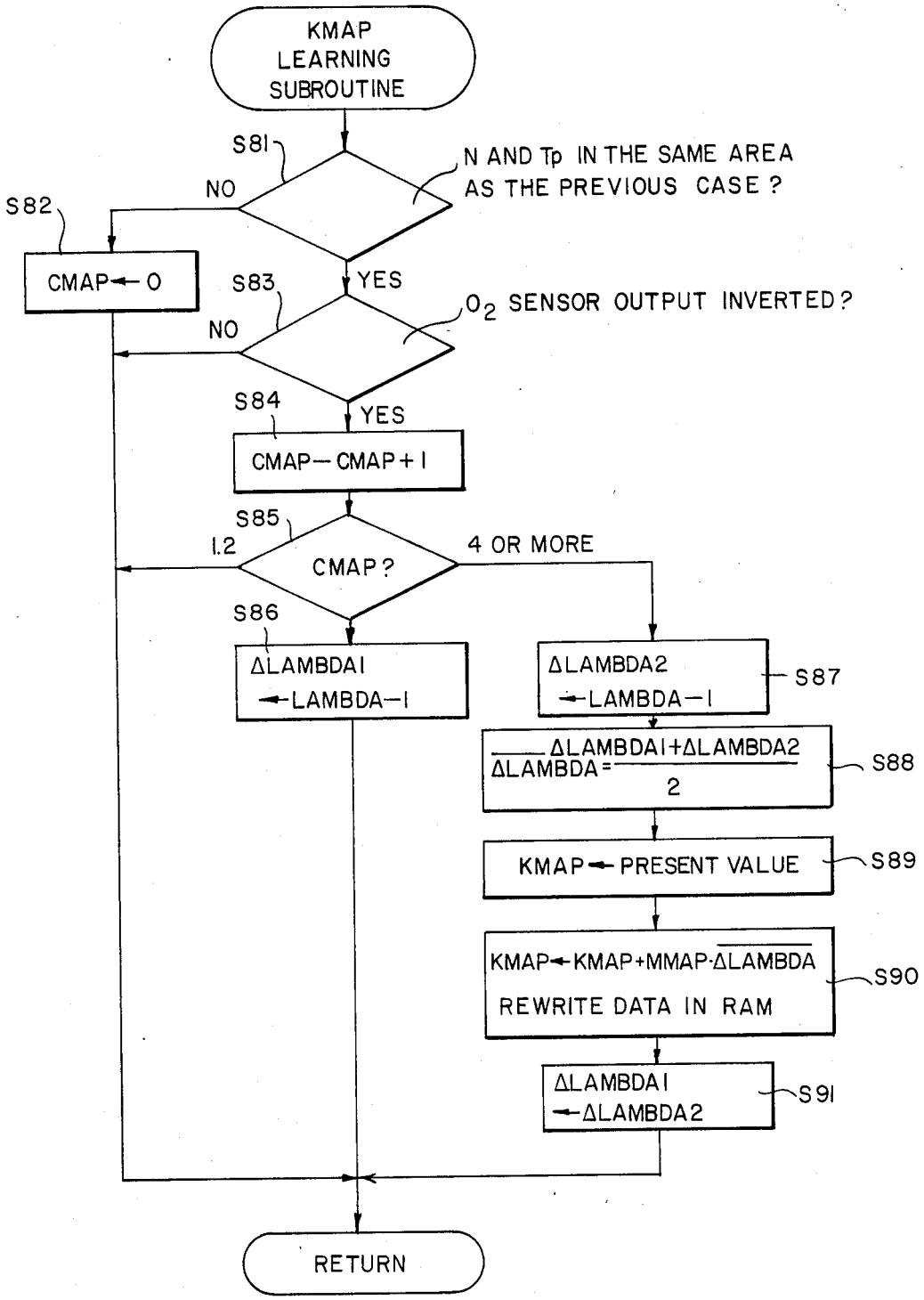

The second embodiment differs from the first embodiment in that the first learning routine shown in FIG. 10, the $K_{ALT}$ learning subroutine shown in FIG. 11 and the $K_{MAP}$ learning subroutine shown in FIG. 12 are executed in place of the first learning routine shown in FIG. 6.

In Step 41 of the first learning routine shown in FIG. 10, the value of the "λ cont" flag is judged. If the value is 0, the process proceeds to Step 42 in which the count values $C_{ALT}$ and $C_{MAP}$ are cleared, and then this routine is ended. This is because no learning can be executed when the air-fuel ratio feedback control is suspended.

When the value of the "λ cont" flag is 1, that is, when the air-fuel ratio feedback control is being effected, the process proceeds to Step 43 and the following Steps in which learning of the global learning correction coefficient $K_{ALT}$ (hereinafter referred to as "$K_{ALT}$ learning") and learning of the area-wise learning correction coefficient $K_{MAP}$ (hereinafter referred to as "$K_{MAP}$ learning") are switched over one from the other.

Figure 13:
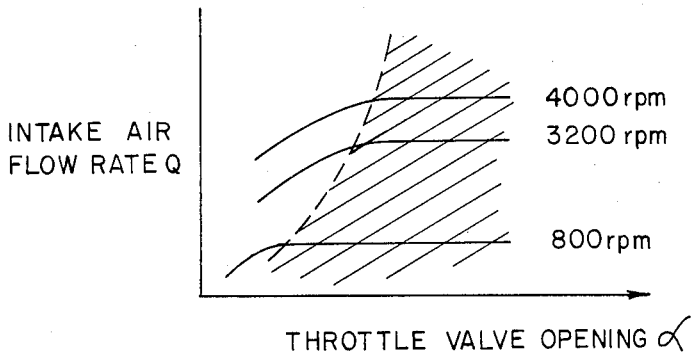
FIG. 13 shows a region for learning the global learning correction coefficient.

More specifically, the $K_{ALT}$ learning is preferentially executed in a predetermined heavy load region wherein the intake air flow rate Q has substantially no change in accordance with the change in the degree of opening $\alpha$ of the throttle valve for each of the engine speeds N as shown by the hatched portion in FIG. 13 (said region will hereinafter be referred to as "Q flat region"), while the $K_{MAP}$ learned is executed in the other regions. Accordingly, a comparison throttle valve opening $\alpha_1$ is retrieved from the engine speed N in Step 43, and the actual throttle valve opening $\alpha$ and the comparison value $\alpha_1$ are compared with each other in Step 44.

If the result of the comparison finds that the actual throttle valve opening $\alpha$ is equal to or greater than the comparison value of (i.e., the Q flat region), in principle the process proceeds to Steps 48 and 49 in which the count value $C_{MAP}$ is cleared and then the $K_{ALT}$ learning subroutine shown in FIG. 11 is executed.

In the case of the single-point injection system, however, the intake air flow velocity is low in a region wherein the degree of opening of the throttle valve is extremely high, so that the distributability of the intake air to each cylinder is deteriorated. Therefore the distribution deterioration region is set in the form of the throttle valve opening with respect to the engine speed, and when the actual throttle valve opening exceeds said set throttle valve opening, the $K_{ALT}$ learning is inhibited. For this purpose, a comparison throttle valve opening $\alpha$222 is retrieved from the engine speed N in Step 45, and the actual throttle valve opening o and the comparison value $\alpha$2 are compared with each other in Step 46. If the actual throttle valve opening $\alpha$ is greater than the comparison value $\alpha$2, the process proceeds to Steps 50 and 51 in which the count value $C_{ALT}$ is cleared and then the process shifts to the $K_{MAP}$ learning subroutine shown in FIG. 12.

Further, in the case of the single-point injection system, the distance from the fuel injection valve 6 to the combustion chamber of the engine 1 is relatively long, so that it is impossible during quick acceleration to effect accurate $K_{ALT}$ learning because of the effect of fuel flowing along the wall of the relatively long passage. Therefore, when quick acceleration is made, the $K_{ALT}$ learning is executed after a predetermined period of time has elapsed, that is, after the wall flow of fuel has become a steady flow. For this reason, it is judged in Step 47 whether or not a predetermined period of time has elapsed after acceleration. If NO, the process proceeds to Steps 50 and 51 in which the count value $C_{ALT}$ is cleared and then the process shifts to the $K_{MAP}$ learning subroutine shown in FIG. 12.

If it is judged in Step 44 that the actual throttle valve opening is smaller than the comparison value $\alpha_1$, the process proceeds to Steps 50 and 51 in which the count value $C_{ALT}$ is cleared and then the process shifts to the $K_{MAP}$ learning subroutine shown in FIG. 12.

The following is a description of the $K_{ALT}$ learning subroutine shown in FIG. 11.

It is judged in Step 61 whether or not the output of the $O_2$ sensor 20 has inverted, that is, whether or not the direction in which the feedback correction coefficient LAMBDA increases or decreases has inverted. Every time this subroutine is repeated, the count value $C_{ALT}$ which represents the number of times of inversion is incremented by one in Step 62. When the count value $C_{ALT}$ reaches, for example, 3, the process proceeds from Step 63 to Step 64 in which the deviation (LAMBDA-1) of the present feedback correction coefficient LAMBDA from the reference value 1 is temporarily stored in the form of $\Delta LAMBDA_1$, and learning is thus started.

When the count value $C_{ALT}$ becomes 4 or more, the process proceeds from Step 63 to Step 65 in which the deviation (LAMBDA-1) of the present feedback correction coefficient LAMBDA from the reference value 1 is temporarily stored in the form of $\Delta LAMBDA_2$.

In this way, the upper and lower peak values $\Delta LAMBDA_1$ and $\Delta LAMBDA_2$ of deviation of the feedback correction coefficient LAMBDA from the reference value 1 are obtained, and the process then proceeds to Step 66 in which a mean value $\overline{\Delta LAMBDA}$ (see the following equation) of these peak values is obtained:

$$\overline{\Delta LAMBDA}=(\Delta LAMBDA_1+\Delta LAMBDA_2)/2$$

Then, the process proceeds to Step 67 in which the present global learning correction coefficient $K_{ALT}$ (the initial value thereof is 0) stored at a predetermined address in the RAM is read out.

The process then proceeds to Step 68 in which the mean value $\overline{\Delta LAMBDA}$ of deviation of the feedback correction coefficient from the reference value is added to the present global learning correction coefficient $K_{ALT}$ at a predetermined rate according to the following equation, thereby calculating a new global learning correction coefficient $K_{ALT}$, and thus correcting and rewriting the global learning correction coefficient data stored at the predetermined address in the RAM:

$$K_{ALT}\leftarrow K_{ALT}+M_{ALT}\cdot\overline{\Delta LAMBDA}$$

($M_{ALT}$ is an addition rate constant; $0<MALT<1$)

Thereafter, $\Delta LAMBDA_2$ is substituted for $\Delta LAMBDA_1$ for the subsequent learning in Step 69.

The $K_{MAP}$ learning subroutine shown in FIG. 12 will next be explained. This $K_{MAP}$ learning subroutine corresponds to the area-wise learning correction coefficient correcting means.

It is judged in Step 81 whether or not the engine speed N and the basic fuel injection quantity Tp, which represent an engine running condition, are within the same area as in the previous case. If NO, the process proceeds to Step 82 in which the count value $C_{MAP}$ is cleared, and this subroutine is then ended.

If YES is the answer in Step 81, it is judged in Step 83 whether or not the output of the $O_2$ sensor has inverted, that is, whether or not the direction in which the feedback correction coefficient LAMBDA increases or decreases has inverted. Every time this subroutine is repeated, the count value $C_{MAP}$ which represents the number of times of inversion is incremented by one in Step 84, and when the count value $C_{MAP}$ reaches, for example, 3, the process proceeds from Step 85 to Step 86 in which the deviation (LAMBDA-1) of the present feedback correction coefficient LAMBDA from the reference value 1 is temporarily stored in the form of $\Delta LAMBDA_1$, and learning is thus started.

When the count value $C_{MAP}$ reaches 4 or more, the process proceeds from Step 85 to Step 87 in which the deviation (LAMBDA-1) of the present feedback correction coefficient LAMBDA from the reference value 1 is temporarily stored in the form of $\Delta LAMBDA_2$.

In this way, the upper and lower peak values $\Delta LAMBDA_1$ and $\Delta LAMBDA_2$ of deviation of the feedback correction coefficient LAMBDA from the reference value 1 are obtained, and the process then proceeds to Step 88 in which a mean value $\overline{\Delta LAMBDA}$ of these values is obtained.

Then, the process proceeds to Step 89 in which an area-wise learning correction coefficient $K_{MAP}$ (the initial value thereof is 0) stored on the map in the RAM in correspondence to the present area is read out by retrieval.

The process then proceeds to Step 90 in which the mean value $\overline{\Delta LAMBDA}$ of deviation of the feedback correction coefficient from the reference value is added to the present area-wise learning correction coefficient $K_{MAP}$ at a predetermined rate according to the following equation, thereby calculating a new area-wise learning correction coefficient $K_{MAP}$, and thus correcting and rewriting the area-wise learning correction coefficient data stored in the same area on the map in the RAM:

$$K_{MAP}\leftarrow K_{MAP}+M_{MAP}\cdot\Delta LAMBDA$$

Thereafter, $\Delta LAMBDA_2$ is substituted for $\Delta LAMBDA_1$ for the subsequent learning in Step 91.

Even in the system which enables the $K_{ALT}$ learning to be executed independently in the Q flat region, if the vehicle climbs a hill in such an engine operation that the Q flat region is not entered, no $K_{ALT}$ learning will progress, and the $K_{MAP}$ learning may be executed including a deviation component due to a change in the air density. If learning progresses only in a small number of areas, a large gap is produced between the learned values, resulting in driveability and exhaust performance being deteriorated. However, execution of the second learning routine shown in FIG. 7 in this case enables reliable global learning of a deviation component due to a change in the air density. It should be noted that in this case the second learning routine shown in FIG. 7 may be executed for a predetermined period of time after the engine key switch has been turned ON.

As has been described above, it is possible according to the present invention to promptly learn a deviation component due to a change in the air density, and therefore it is advantageously possible to effect excellent learning control of the air-fuel ratio even when the vehicle abruptly goes up or down a slope.

Although the present invention has been described above through specific terms, it should be noted here that the described embodiments are not necessarily exclusive and various changes and modifications may be imparted thereto without departing from the scope of the invention which is limited solely by the appended claims.

What is claimed is:

1. An apparatus for learn-controlling the air-fuel ratio for an internal combustion engine, comprising:

engine running condition detecting means for detecting an engine running condition including at least a parameter concerning the quantity of air which is sucked into the engine;

air-fuel ratio detecting means for detecting the air-fuel ratio of the air-fuel mixture which is sucked into the engine by detecting a component of exhaust gas from the engine;

basic fuel injection quantity setting means for setting a basic fuel injection quantity on the basis of said parameter detected by said engine running condition detecting means;

rewritable global learning correction coefficient storing means for storing a global learning correction coefficient employed for globally correcting said basic fuel injection quantity for all the engine running condition areas;

rewritable area-wise learning correction coefficient storing means for storing an area-wise learning correction coefficient employed for correcting said basic fuel injection quantity for each of said engine running condition areas;

area-wise learning correction coefficient retrieving means for retrieving on the basis of an actual engine running condition an area-wise learning correction coefficient in the corresponding engine running condition area stored in said area-wise learning correction coefficient storing means;

feedback correction coefficient setting means for comparing the air-fuel ratio detected by said air-fuel ratio detecting means with a target air-fuel ratio and setting a feedback correction coefficient for correcting said basic fuel injection quantity by increasing or decreasing said feedback correction coefficient by a predetermined amount so that the actual air-fuel ratio is convergent on said target air-fuel ratio;

fuel injection quantity calculating means for calculating a fuel injection quantity on the basis of the basic fuel injection quantity set by said basic fuel injection quantity setting means, the global learning correction coefficient stored in said global learning correction coefficient storing means, the area-wise learning correction coefficient retrieved by said area-wise learning correction coefficient retrieving means, and the feedback correction coefficient set by said feedback correction coefficient setting means;

fuel injection means for injecting fuel into the engine in an ON/OFF manner in response to a driving pulse signal which is equivalent to the fuel injection quantity calculated by said fuel injection quantity calculating means;

area-wise learning correction coefficient correcting means for learning a deviation of said feedback correction coefficient from a reference value for each of the engine running condition areas and correcting as well as rewriting the corresponding area-wise learning correction coefficient stored in said area-wise learning correction coefficient storing means so that said deviation is minimized;

area-wise learning progress detecting means for issuing a first global learning command every time the area-wise learning correction coefficients for a predetermined number of different engine running condition areas are corrected by said area-wise learning correction coefficient correcting means;

learning direction judging means for judging the direction of deviations of the present area-wise learning correction coefficients from a reference value for a predetermined number of different engine running condition areas when the first global learning command is issued from said area-wise learning progress detecting means, and issuing a second global learning command when all the deviations have the same direction;

mean value calculating means for calculating a mean value of deviations of the present area-wise learning correction coefficients from the reference value for the predetermined number of different engine running condition areas when the second global learning command is issued from said learning direction judging means;

global learning correction coefficient correcting means for correcting and rewriting the global learning correction coefficient stored in said global learning correction coefficient storing means by adding the mean value calculated by said mean value calculating means to the global learning correction coefficient stored in said global learning correction coefficient storing means; and second area-wise learning correction coefficient correcting means for correcting and rewriting the area-wise learning correction coefficients stored in said area-wise learning correction coefficient storing means and on the basis of which said mean value was calculated by subtracting the mean value calculated by said mean value calculating means from the area-wise learning correction coefficients.

2. An apparatus for learning and controlling an air/fuel ratio in an internal combustion engine according to claim 1, wherein the basic fuel injection quantity setting means includes means for computing the basic fuel injection quantity Tp according to the relational formula of $Tp=K.Q/N$ wherein Q stands for the sucked air flow quantity, N stands for the engine rotation number and K is a constant.

3. An apparatus for learning and controlling an air/fuel ratio in an internal combustion engine according to claim 2, wherein the engine driving state detecting means comprises means for detecting the opening degree of the throttle valve and means for detecting the engine rotation number and the basic fuel injection quantity setting means comprises means for estimating the sucked air flow quantity from the opening degree of the throttle valve and the engine rotation number.

4. An apparatus for learning and controlling an air/fuel ratio in an internal combustion engine according to claim 1, wherein the area-wise learning correction coefficient storing means stores the areawise learning correction coefficient for each of areas sorted according to the engine rotation number and basic fuel injection quantity.

5. An apparatus for learning and controlling an air/fuel ratio in an internal combustion engine according to claim 1, wherein the fuel injection quantity calculating means includes means for computing the fuel injection quantity Ti according to the relational formula of $Ti=Tp\ (LAMBDA+K_{ALT}+K_{MAP})$ wherein Tp stands for the basic fuel injection quantity, $K_{ALT}$ stands for the altitude learning correction coefficient, $K_{MAP}$ stands for the area-wise learning correction coefficient and LAMBDA stands for the feedback correction coefficient.

6. An apparatus for learn-controlling the air-fuel ratio for an internal combustion engine, comprising:

engine running condition detecting means for detecting an engine running condition including at least a parameter concerning the quantity of air which is sucked into the engine;

air-fuel ratio detecting means for detecting the air-fuel ratio of the air-fuel mixture which is sucked into the engine by detecting a component of exhaust gas from the engine;

basic fuel injection quantity setting means for setting a basic fuel injection quantity on the basis of said parameter detected by said engine running condition detecting means;

rewritable global learning correction coefficient storing means for storing a global learning correction coefficient employed for globally correcting said basic fuel injection quantity for all the engine running condition areas;

rewritable area-wise learning correction coefficient storing means for storing an area-wise learning correction coefficient employed for correcting said basic fuel injection quantity for each of said engine running condition areas;

area-wise learning correction coefficient retrieving means for retrieving on the basis of an actual engine running condition an area-wise learning correction coefficient in the corresponding engine running condition area stored in said area-wise learning correction coefficient storing means;

feedback correction coefficient setting means for comparing the air-fuel ratio detected by said air-fuel ratio detecting means with a target air-fuel ratio and setting a feedback correction coefficient for correcting said basic fuel injection quantity by increasing or decreasing said feedback correction coefficient by a predetermined amount so that the actual air-fuel ratio is convergent on said target air-fuel ratio;

fuel injection quantity calculating means for calculating a fuel injection quantity on the basis of the basic fuel injection quantity set by said basic fuel injection quantity setting means, the global learning correction coefficient stored in said global learning correction coefficient storing means, the area-wise learning correction coefficient retrieved by said area-wise learning correction coefficient retrieving means, and the feedback correction coefficient set by said feedback correction coefficient setting means;

fuel injection means for injecting fuel into the engine in an ON/OFF manner in response to a driving pulse signal which is equivalent to the fuel injection quantity calculated by said fuel injection quantity calculating means;

first area-wise learning correction coefficient correcting means for learning a deviation of said feedback correction coefficient from a reference value for each of the engine running condition areas and correcting as well as rewriting the corresponding area-wise learning correction coefficient stored in said area-wise learning correction coefficient storing means so that said deviation is minimized;

area-wise learning progress detecting means for issuing a first global learning command every time the area-wise learning correction coefficients for a predetermined number of different engine running condition areas are corrected by said areawise learning correction coefficient correcting means;

learning direction judging means for judging the direction of deviations of the present area-wise learning correction coefficients from a reference value for a predetermined number of different engine running condition areas when the first global learning command is issued from said area-wise learning progress detecting means, and issuing a second global learning command when all the deviations have the same direction;

minimum value calculating means for calculating a minimum value among deviations of the present area-wise learning correction coefficients from the reference value in terms of the absolute value for the predetermined number of different engine running condition areas when the second global learning command is issued from said learning direction judging means;

global learning correction coefficient correcting means for correcting and rewriting the global learning correction coefficient stored in said global learning correction coefficient storing means by adding the minimum value calculated by said minimum value calculating means to the global learning correction coefficient stored in said global learning correction coefficient storing means; and second area-wise learning correction coefficient correcting means for correcting and rewriting the area-wise learning correction coefficients stored in said area-wise learning correction coefficient storing means and on the basis of which said minimum value was calculated by subtracting the minimum value calculated by said minimum value calculating means from the area-wise learning correction coefficients.

7. An apparatus for learning and controlling an air/fuel ratio in an internal combustion engine according to claim 6, wherein the basic fuel injection quantity setting means includes means for computing the basic fuel injection quantity setting means includes means for computing the basic fuel injection quantity Tp according to the relational formula of $Tp=K.Q/N$ wherein Q stands for the sucked air flow quantity, N stands for the engine rotation number and K is a constant.

8. An apparatus for learning and controlling an air/fuel ratio in an internal combustion engine according to claim 6, wherein the fuel injection quantity calculating means includes means for computing the fuel injection quantity Ti according to the relational formula of $Ti=Tp\ (LAMBDA+K_{ALT}+K_{MAP})$ wherein Tp stands for the basic fuel injection quantity, $K_{ALT}$ stands for the altitude learning correction coefficient, $K_{MAP}$ stands for the area-wise learning correction coefficient and LAMBDA stands for the feedback correction coefficient.

9. A method of learn-controlling the airfuel ratio for an internal combustion engine, said method comprising the steps of:

detecting an engine running condition including at least a parameter concerning the quantity of air which is sucked into the engine with an engine running condition detector;

detecting the air-fuel ratio of the air-fuel mixture which is sucked into the engine by detecting a component of exhaust gas from the engine with an air-fuel ratio detector;

setting a basic fuel injection quantity on the basis of said parameter detected by said engine running condition detector;

storing a global learning correction coefficient employed for globally correcting said basic fuel injection quantity for all the engine running condition areas in a rewritable global learning correction coefficient memory;

storing an area-wise learning correction coefficient employed for correcting said basic fuel injection quantity for each of said engine running condition areas in a rewritable area-wise learning correction coefficient memory;

retrieving on the basis of an actual engine running condition an area-wise learning correction coefficient in the corresponding engine running condition area stored in said area-wise learning correction coefficient memory;

comparing the air-fuel ratio detected by said air-fuel ratio detector with a target air-fuel ratio and setting a feedback correction coefficient for correcting said basic fuel injection quantity by increasing or decreasing said feedback correction coefficient by a predetermined amount so that the actual air-fuel ratio is convergent on said target air-fuel ratio;

calculating a fuel injection quantity on the basis of the basic fuel injection quantity, the global learning correction coefficient stored in said global learning correction coefficient memory, the area-wise learning correction coefficient retrieved from said area-wise learning correction coefficient memory, and the feedback correction coefficient;

injecting fuel into the engine in an ON/OFF manner in response to a driving pulse signal which is equivalent to the calculated fuel injection quantity with a fuel injection device.

learning a deviation of said feedback correction coefficient from a reference value for each of the engine running condition areas and correcting as well as rewriting the corresponding area-wise learning correction coefficient stored in said learning correction coefficient memory so that said deviation is minimized;

issuing a first global learning command every time the area-wise learning correction coefficients for a predetermined number of different engine running condition areas are corrected by judging the direction of deviations of the present area-wise learning correction coefficients from a reference value for a predetermined number of different engine running condition areas when the first global learning command is issued, and issuing a second global learning command when all the deviations have the same direction;

calculating a mean value of deviations of the present area-wise learning correction coefficients from the reference value for the predetermined number of different engine running condition areas when the second global learning command is issued;

correcting and rewriting the global learning correction coefficient stored in said global learning correction coefficient memory by adding the calculated mean value to the global learning correction coefficient memory; and correcting and rewriting the area-wise learning correction coefficients stored in said area-wise learning correction coefficient memory and on the basis of which said mean value was calculated by subtracting the calculated mean value the area-wise learning correction coefficients.

10. A method of learn-controlling the air-fuel ratio for an internal combustion engine, said method comprising the steps of:

detecting an engine running condition including at least a parameter concerning the quantity of air which is sucked into the engine with an engine running detector;

detecting the air-fuel ratio of the air-fuel mixture which is sucked into the engine by detecting a component of exhaust gas from the engine with an air-fuel ratio detector;

for setting a basic fuel injection quantity on the basis of said parameter detected by said engine running condition detector.

storing a global learning correction coefficient employed for globally correcting said basic fuel injection quantity for all the engine running condition areas in a rewritable global learning correction coefficient memory;

storing an area-wise learning correction coefficient employed for correcting said basic fuel injection quantity for each of said engine running condition areas in a rewritable area-wise learning correction coefficient memory;

retrieving on the basis of an actual engine running condition an area-wise learning correction coefficient in the corresponding engine running condition area stored in said area-wise learning correction coefficient memory;

comparing the air-fuel ratio detected by said air-fuel ratio detector with a target air-fuel ratio and setting a feedback correction coefficient for correcting said basic fuel injection quantity by increasing or decreasing said feedback correction coefficient by a predetermined amount so that the actual air-fuel ratio is convergent on said target air-fuel ratio;

calculating a fuel injection quantity on the basis of the basic fuel injection quantity, the global learning correction coefficient stored in said global learning correction coefficient memory, the area-wise learning correction coefficient retrieved from said area-wise learning correction coefficient memory, and the feedback correction coefficient;

injecting fuel into the engine in an ON/OFF manner in response to a driving pulse signal which is equivalent to the fuel injection quantity calculated with a fuel injection device.

learning a deviation of said feedback correction coefficient from a reference value for each of the engine running condition areas and correcting as well as rewriting the corresponding area-wise learning correction coefficient stored in said area-wise learning correction coefficient memory so that said deviation is minimized;

issuing a first global learning command every time the area-wise learning correction coefficients for a predetermined number of different engine running condition areas are corrected;

judging the direction of deviations of the present area-wise learning correction coefficients from a reference value for a predetermined number of different engine running condition areas when the first global learning command is issued, and issuing a second global learning command when all the deviations have the same direction;

calculating a minimum value among deviations of the present area-wise learning correction coefficients from the reference value in terms of the absolute value for the predetermined number of different engine running condition areas when the second global learning command is issued;

correcting and rewriting the global learning correction coefficient stored in said global learning correction coefficient memory by adding the minimum value calculated to the global learning correction coefficient stored in said global learning correction coefficient memory; and correcting and rewriting the area-wise learning correction coefficients stored in said areawise learning correction coefficient memory and on the basis of which said minimum value was calculated by subtracting the minimum value calculated by said minimum value calculating means from the area-wise learning correction coefficients.

* * * * *